US010343823B2

(12) United States Patent
Denize

(10) Patent No.: US 10,343,823 B2
(45) Date of Patent: Jul. 9, 2019

(54) COVER FOR CLOSING A BOX AND ASSEMBLY COMPRISING A BOX AND A COVER OF SAID TYPE

(71) Applicant: FILLON TECHNOLOGIES, Faverolles (FR)

(72) Inventor: Cyril Denize, Morancez (FR)

(73) Assignee: FILLON TECHNOLOGIES, Faverolles (FR)

( * ) Notice: Subject to any disclaimer, the term of this patent is extended or adjusted under 35 U.S.C. 154(b) by 505 days.

(21) Appl. No.: 15/023,449

(22) PCT Filed: Sep. 15, 2014

(86) PCT No.: PCT/FR2014/052282
§ 371 (c)(1),
(2) Date: Mar. 21, 2016

(87) PCT Pub. No.: WO2015/044555
PCT Pub. Date: Apr. 2, 2015

(65) Prior Publication Data

US 2016/0207667 A1 Jul. 21, 2016

(30) Foreign Application Priority Data

Sep. 24, 2013 (FR) ..... 13 59160

(51) Int. Cl.
*B65D 45/20* (2006.01)
*B65D 43/02* (2006.01)
(Continued)

(52) U.S. Cl.
CPC ..... *B65D 43/0212* (2013.01); *B01F 7/1695* (2013.01); *B01F 15/00779* (2013.01);
(Continued)

(58) Field of Classification Search
CPC ..... B01F 7/1695; B01F 15/00779; B65D 43/0212; B65D 2543/00231;
(Continued)

(56) References Cited

U.S. PATENT DOCUMENTS 2,089,371 A * 8/1937 Heller ..... B65D 43/0212 229/5.7
3,139,270 A * 6/1964 Steinbock, Jr. ..... B01F 7/1695 366/114
(Continued)

FOREIGN PATENT DOCUMENTS

EP 1552963 7/2005
FR 1070380 7/1954
(Continued)

OTHER PUBLICATIONS

Japanese Office Action dated Apr. 3, 2018.
Search Report dated 2015.

*Primary Examiner* — J. Gregory Pickett
*Assistant Examiner* — Niki M Eloshway
(74) *Attorney, Agent, or Firm* — Ipsilon USA, LLP

(57) ABSTRACT

A lid (1) for closing a can having a collar, the lid having a bottom face (2) provided with an annular sealing gasket (4) bearing against said collar when the lid (1) is in the closed state, and being provided with fastener means (14) for fastening the lid (1) to the can, which fastener means (14) comprise at least two catches (141, 142, 143) disposed about the sealing gasket (4) and having an active fastener portion (1411, 1421, 1431) that projects towards the center of the lid (1), and that is positionable under an external radial peripheral rim of the can when a movable one (143) of the catches is in a closer position in which it is closer to the other catches (141, 142). The movable catch (143) is mounted to move about an axis (XX') or in a plane that is substantially parallel to a circumferential plane of the annular gasket (4), and the
(Continued)

lid (1) is provided with locking means (19) for locking said movable catch (143) in the closer position in which its active fastener portion is closer to the active fastener portions of the other catches (141, 142), these locking means (19) being unlockable.

14 Claims, 14 Drawing Sheets

(51) Int. Cl.
*B65D 43/06* (2006.01)
*B01F 7/16* (2006.01)
*B01F 15/00* (2006.01)

(52) U.S. Cl.
CPC ..... *B65D 2543/00092* (2013.01); *B65D 2543/00231* (2013.01); *B65D 2543/00296* (2013.01); *B65D 2543/00435* (2013.01); *B65D 2543/00537* (2013.01); *B65D 2543/00574* (2013.01); *B65D 2543/00629* (2013.01); *B65D 2543/00685* (2013.01); *B65D 2543/00768* (2013.01); *B65D 2543/00805* (2013.01); *B65D 2543/00842* (2013.01); *B65D 2543/00972* (2013.01)

(58) Field of Classification Search
CPC ..... B65D 2543/00296; B65D 2543/00435; B65D 2543/00537; B65D 2543/00574; B65D 2543/00629; B65D 2543/00685; B65D 2543/00768; B65D 2543/00805; B65D 2543/00842; B65D 2543/972
USPC ..... 220/212, 378, 324
See application file for complete search history.

(56) References Cited

U.S. PATENT DOCUMENTS

| | | | | |
|---|---|---|---|---|
| 3,162,338 | A * | 12/1964 | Grubelic | B01F 7/1695 220/325 |
| 3,360,155 | A | 12/1967 | Colonna | |
| 4,865,233 | A * | 9/1989 | Kain | B44D 3/127 222/482 |
| 5,711,449 | A * | 1/1998 | Arn | B65D 90/105 220/293 |
| 6,053,347 | A | 4/2000 | Fullin | |
| 9,038,674 | B2 * | 5/2015 | Steele | B67D 3/0061 141/1 |
| 2002/0145939 | A1 * | 10/2002 | Keough | B01F 7/1695 366/247 |
| 2003/0099153 | A1 * | 5/2003 | Renfro | B01F 7/1695 366/169.1 |
| 2005/0023772 | A1 | 2/2005 | England | |
| 2005/0045665 | A1 * | 3/2005 | Krzywdziak | B44D 3/127 222/469 |
| 2006/0000838 | A1 * | 1/2006 | Santrach | B01F 7/1695 220/700 |
| 2008/0223810 | A1 | 9/2008 | Garcia | |
| 2010/0012655 | A1 * | 1/2010 | Dathy | B44D 3/127 220/262 |
| 2010/0163562 | A1 * | 7/2010 | Madsen | B65D 21/0212 220/324 |

FOREIGN PATENT DOCUMENTS

| | | |
|---|---|---|
| JP | H09156658 | 6/1997 |
| JP | 2005096867 | 4/2005 |

* cited by examiner

COVER FOR CLOSING A BOX AND ASSEMBLY COMPRISING A BOX AND A COVER OF SAID TYPE

RELATED APPLICATIONS

This application is a National Phase Application of PCT/FR2014/052282, filed on Sep. 15, 2014, which in turn claims the benefit of priority from French Patent Application No. 13 59160 filed on Sep. 24, 2013, the entirety of which are incorporated herein by reference.

BACKGROUND

Field of the Invention

The present invention relates to a lid for closing a can having a tubular side wall, and to an assembly of the type comprising a can and a lid of the above-mentioned type.

The invention relates more particularly to a lid for closing a can having a tubular side wall provided with a top opening, with an internal radial collar, and with an external radial peripheral rim, the collar and the rim being disposed substantially at the same level as the top opening, said lid having a "bottom" face provided with an annular sealing gasket suitable for coming to bear against said collar when the top opening of the can is in the closed state in which it is closed by said lid, and said lid being provided with fastener means for fastening the lid to the can, which fastener means comprise at least two catches disposed around the sealing gasket and extending at least partially projecting from the bottom face of the lid, at least two or each of the catches having an active fastener portion formed by a portion of the catch that projects towards the center of the lid, at least one of the catches, referred to as a "movable" catch, being movable between a closer position in which its active fastener portion is closer to the active fastener portion of at least one other catch and a farther-away position in which its active fastener portion is farther away from the active fastener portion of at least one other catch, said active fastener portions being suitable, in a closer position corresponding to the active closure position in which the lid is actively closed, for positioning themselves under the external radial peripheral rim of the can.

Description of Related Art

Such lids are used, in particular, for closing cans of paint.

Currently, the means for fastening such a lid to such a can are formed either by spring-loaded cam levers as illustrated, for example, in Patent FR 2 707 258, or else by elastically deformable catches, as illustrated in European Patent EP 1 510 363. Both of those modes of fastening suffer from drawbacks. Specifically, the cam lever system requires the presence of springs and must be placed partially in contact with the contents of the can. The elastically deformable catch system requires various lid sizes to be available to adapt to the various can sizes. Also, the lid is difficult to remove from the can, and requires, in particular, a large amount of manual pressure to be exerted on the catches in order to deform them, with the risk of tipping over the can.

OBJECTS AND SUMMARY

An object of the present invention is thus to propose a lid of the above-mentioned type, of a design that makes it possible to overcome the drawbacks of the prior art.

Another object of the present invention is to propose a lid of the above-mentioned type, of a design that enables the lid to be easy to put into place and to remove from the can, the lid being suitable for adapting to a large number of can formats.

Another object of the present invention is to propose a lid of the above-mentioned type, of a design that makes it possible to remove the risks of the lid being separated from the can in untimely manner, such risks being observed, in particular, when the lid is connected to the can by elastically deformable catches.

For this purpose, the invention provides a lid for closing a can having a tubular side wall provided with a top opening, with an internal radial collar, and with an external radial peripheral rim, the collar and the rim being disposed substantially at the same level as the top opening, said lid having a "bottom" face provided with an annular sealing gasket suitable for coming to bear against said collar when the top opening of the can is in the closed state in which it is closed by said lid, and said lid being provided with fastener means for fastening the lid to the can, which fastener means comprise at least two catches disposed around the sealing gasket and extending at least partially projecting from the bottom face of the lid, at least two or each of the catches having an active fastener portion formed by a portion of the catch that projects towards the center of the lid, at least one of the catches, referred to as a "movable" catch, being movable between a closer position in which its active fastener portion is closer to the active fastener portion of at least one other catch and a farther-away position in which its active fastener portion is farther away from the active fastener portion of at least one other catch, said active fastener portions being suitable, in a closer position corresponding to the active closure, position in which the lid is actively closed, for positioning themselves under the external radial peripheral rim of the can, said lid being characterized in that, for causing the active fastener portion of the movable catch provided with an active fastener portion or of at least one of the movable catches provided with active fastener portions to move between a closer position in which it is closer to the active fastener portion of at least one other catch and a farther-away position in which it is farther away from the active fastener portion of at least one other catch, said movable catch provided with an active fastener portion or at least one of the movable catches provided with active fastener portions is mounted to move about an axis, or in a plane substantially parallel to a circumferential plane of the annular sealing gasket, and in that, for said at least one movable catch, the lid is provided with locking means for locking said movable catch in the closer position in which its active fastener portion is closer to the active fastener portion of at least one other catch, these locking means being unlockable.

Because the active fastener portion of the at least one movable catch provided with an active fastener portion is mounted to move about an axis, or to be free to slide in a plane substantially parallel to a circumferential plane of the annular sealing gasket, in order to be moved between a closer position in which it is closer to the active fastener portion of at least one other catch and a farther-away position in which it is farther away from the active fastener portion of at least one other catch, it is possible for the catch to have a long movement stroke, enabling it to adapt to various can formats.

Because the lid is provided with locking means for preventing pivotal movement or sliding of said movable catch, which locking means are configured so that, in the locked position, they prevent the pivotally or slidably movable catch from pivoting or sliding in a direction in which its active fastener portion moves away from the active fastener portion of at least one other catch under the action of thrust or of traction exerted on said catch, any risk of untimely separating of the lid from the can is prevented.

Preferably, said at least one movable catch is a pivotally mounted catch.

Preferably, the locking means comprise first locking means mounted to be constrained to move with the movable catch and stationary second locking means, said first and second locking means being coupled together in the locked position and decoupled in the unlocked position.

Preferably, the first and second locking means are of the male/female type.

Preferably, the locking means are at least partially elastically deformable and are suitable for going from the locked position to the unlocked position, and vice versa, by elastic deformation combined with pivotal movement of the pivotally movable catch. As a result, the locking control is simpler.

Preferably, the lid has a top face opposite from the bottom face and that forms a pouring spout having a seat for a closure flap, said closure flap being a slidably mounted closure flap equipped with return means for urging it back into the closed position, and with a pivotally mounted active opening control lever for actively opening the closure flap by acting against said return means, said pivotally mounted opening control lever for opening the closure flap overlying the movable catch or one of the movable catches. This configuration makes it possible to reduce the overall size of the assembly and, by means of the pivotally mounted lever for controlling the closure flap, makes it possible to move the movable catch overlaid by said lever, and optionally to lock the locking means.

Specifically, the pivotally mounted opening control lever for opening the closure flap is preferably mounted to move pivotally about an axis parallel to the pivot axis (XX') or to the movement plane of the movable catch that it overlies.

Preferably, when the movable catch is a pivotally mounted catch, the pivotally mounted opening control lever for opening the closure flap also, if necessary, when the closure flap is caused to open, forms a locking control member for locking the locking means for preventing pivoting of the pivotally movable catch that underlies said lever.

In order to reduce the muscular effort that needs to be made, in particular when the pivotally mounted opening control lever for opening the closure flap has multiple purposes and also causes the movable catch to pivot and the locking means to lock, the seat of the pouring spout slopes downwards from the periphery towards the center of the lid.

Preferably, the annular sealing gasket is an elastically deformable gasket that, in the non-deformed state, is in the general shape of a half-torus with its convex side facing towards the can.

This gasket configuration makes it possible, firstly, to reinforce the spring effect of the gasket in the direction in which the lid is moved, away from the can, thereby increasing the pressure force exerted by the fastener means for fastening the lid to the can when the fastener means are in the active position, and, secondly for the gasket to adapt to a large number of formats for the internal radial collar of the can.

Preferably, the lid is provided with a handle.

Even more preferably, the lid is provided with a central opening designed for the rotary shaft of a mixer assembly.

Preferably, at least a portion of the locking means is carried by the handle.

Preferably, when the locking means comprise first locking means mounted to be constrained to move with the pivotally movable catch, and stationary second locking means, the portion of the means that is carried by the handle forms the stationary second locking means.

Preferably, the pivotally movable catch or at least one of the pivotally movable catches is mounted to move pivotally via a control lever for causing it to move pivotally, and the first locking means for preventing pivotal movement of said pivotally movable catch are carried by said control lever and the second locking means are carried by the handle.

Preferably, the control lever for causing the catch to move pivotally and said catch are formed in one piece.

In general, the control lever for causing the catch to move pivotally underlies the pivotally mounted opening control lever for opening the closure flap, so that causing the opening control lever for opening the closure flap to move pivotally in the direction in which the closure flap opens can, if necessary, generate, in parallel, by bearing contact between said levers, pivotal movement of the control lever for moving the catch and, as a result, cause the pivotally movable catch to go from an unlocked first angular position to a locked second angular position.

This configuration makes it possible to avoid any conflict in the movements of the two levers.

The invention further provides an assembly of the type comprising firstly a can having a tubular side wall provided with a top opening, with an internal radial collar, and with an external radial peripheral rim, the collar and the rim being disposed substantially at the same level as the top opening, and secondly a lid for closing the can, said lid, which is dimensioned to cover the top opening of the can, being provided with fastener means for fastening to the can, and, on its "bottom" face, with an elastically deformable annular sealing gasket that is suitable for coming to bear against said collar when the top opening of the can is in the closed state in which it is closed by said lid, said fastener means comprising at least two catches disposed around the sealing gasket and extending at least partially projecting from the bottom face of the lid, at least two or each of the catches having an active fastener portion formed by a portion of the catch that projects towards the center of the lid, at least one of the catches, referred to as a "movable" catch, being movable between a closer position in which its active fastener portion is closer to the active fastener portion of at least one other catch and a farther-away position in which its active fastener portion is farther away from the active fastener portion of at least one other catch, said active fastener portions being arranged, in a closer position corresponding to the active closure position in which the lid is actively closed, for positioning themselves under the external radial peripheral rim of the can, when the lid is positioned over the top opening of the can, said assembly being characterized in that the lid is of the above-mentioned type.

BRIEF DESCRIPTION OF THE DRAWINGS

The invention can be well understood on reading the following description of embodiments given with reference to the accompanying drawings, in which.

DETAILED DESCRIPTION

Figure 1:
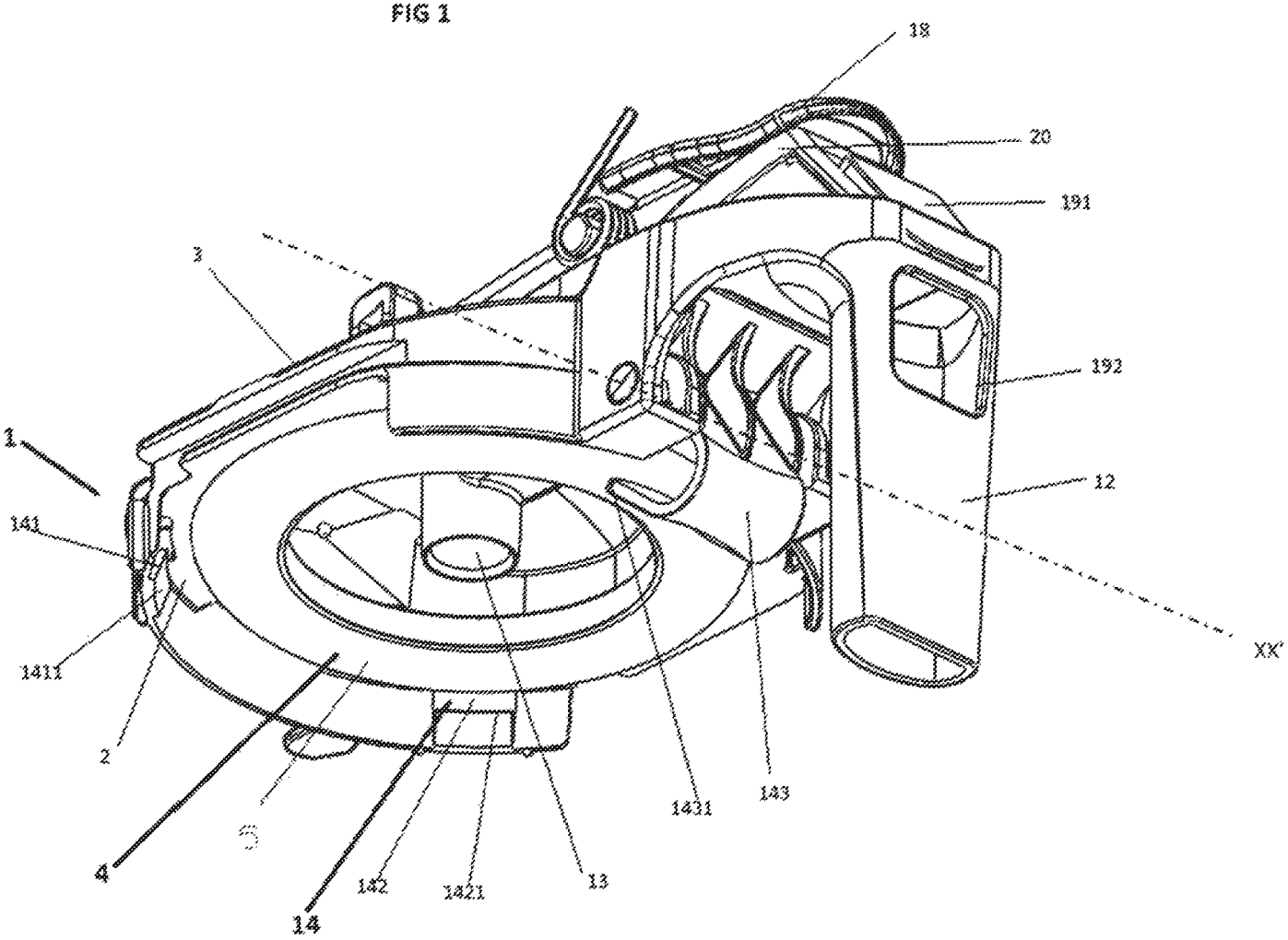
FIG. 1 is a perspective view of a lid of the invention with said pivotally movable catch in the unlocked position, and with the active fastener portion of the pivotally movable catch being in the farther-away position in which it is farther away from the active fastener portions of the other catches.
Figure 2:
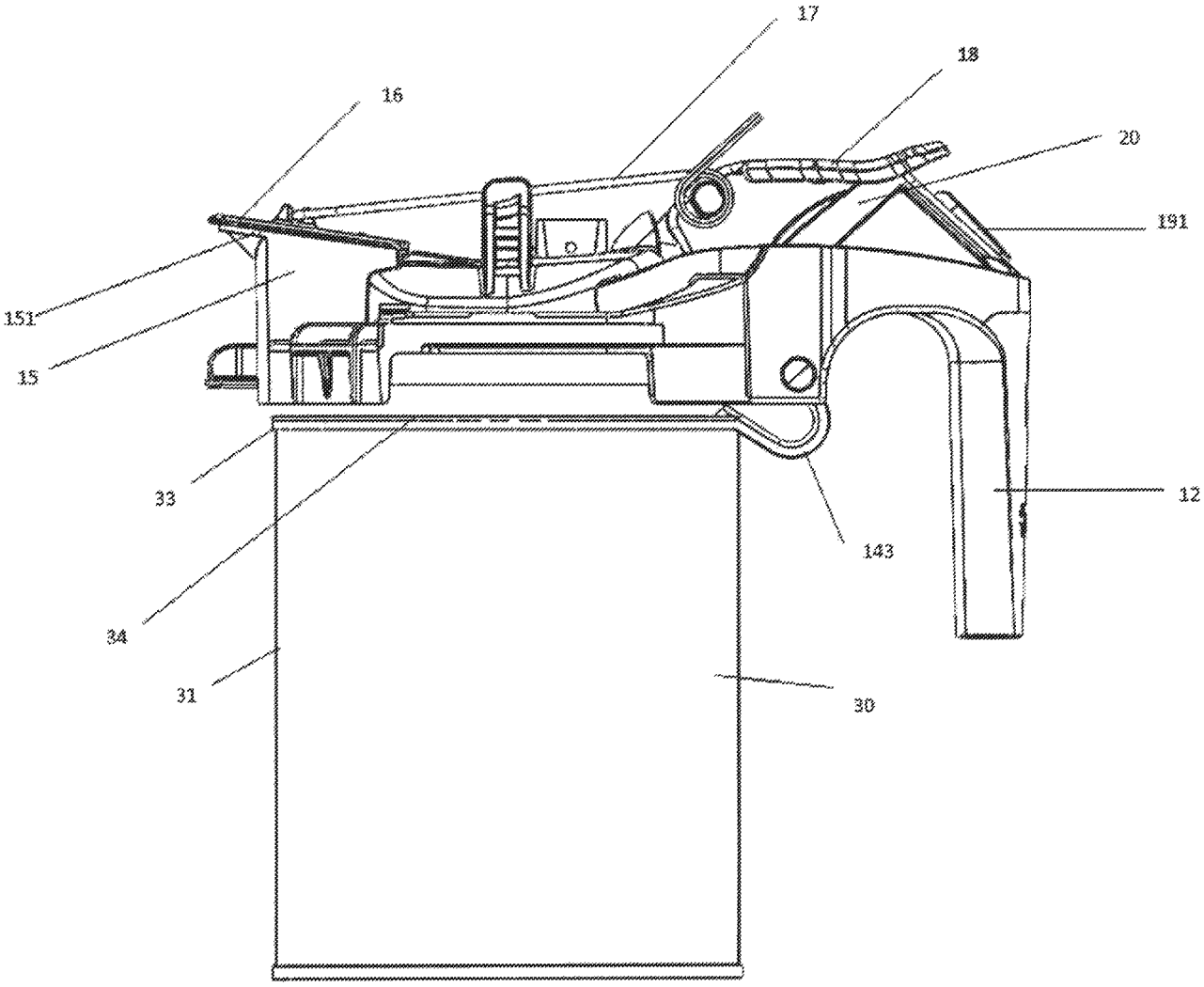
FIG. 2 is a side view of a can-and-lid assembly while the lid is being fastened to the can, the lid being positioned above the top opening of the can.
Figure 3:
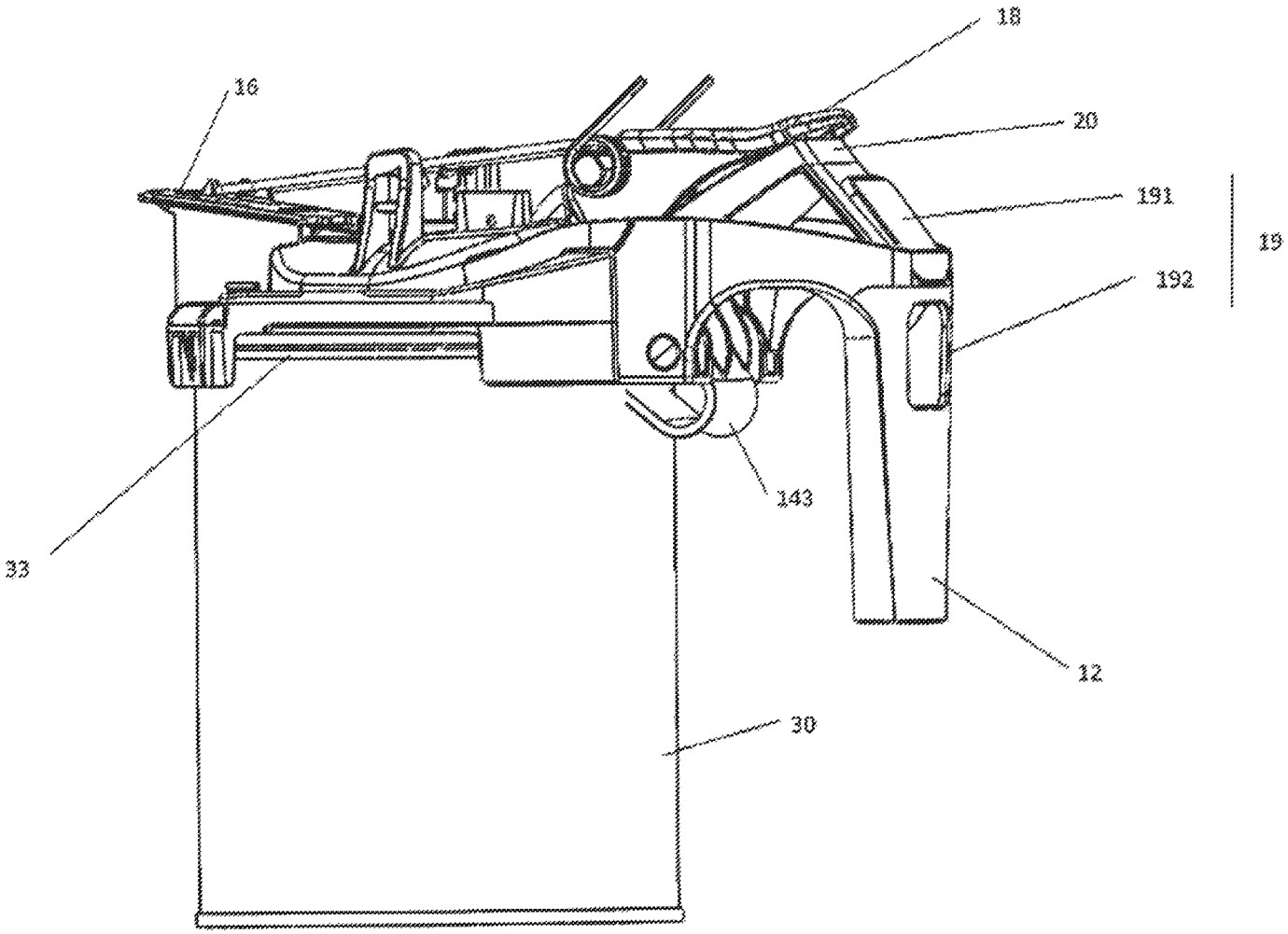
FIG. 3 is a perspective view of a can-and-lid assembly in which the active fastener portions of the catches of the lid are positioned on the can at a level lower than the external radial peripheral rim of the can, the movable catch being in the unlocked position.
Figure 4:
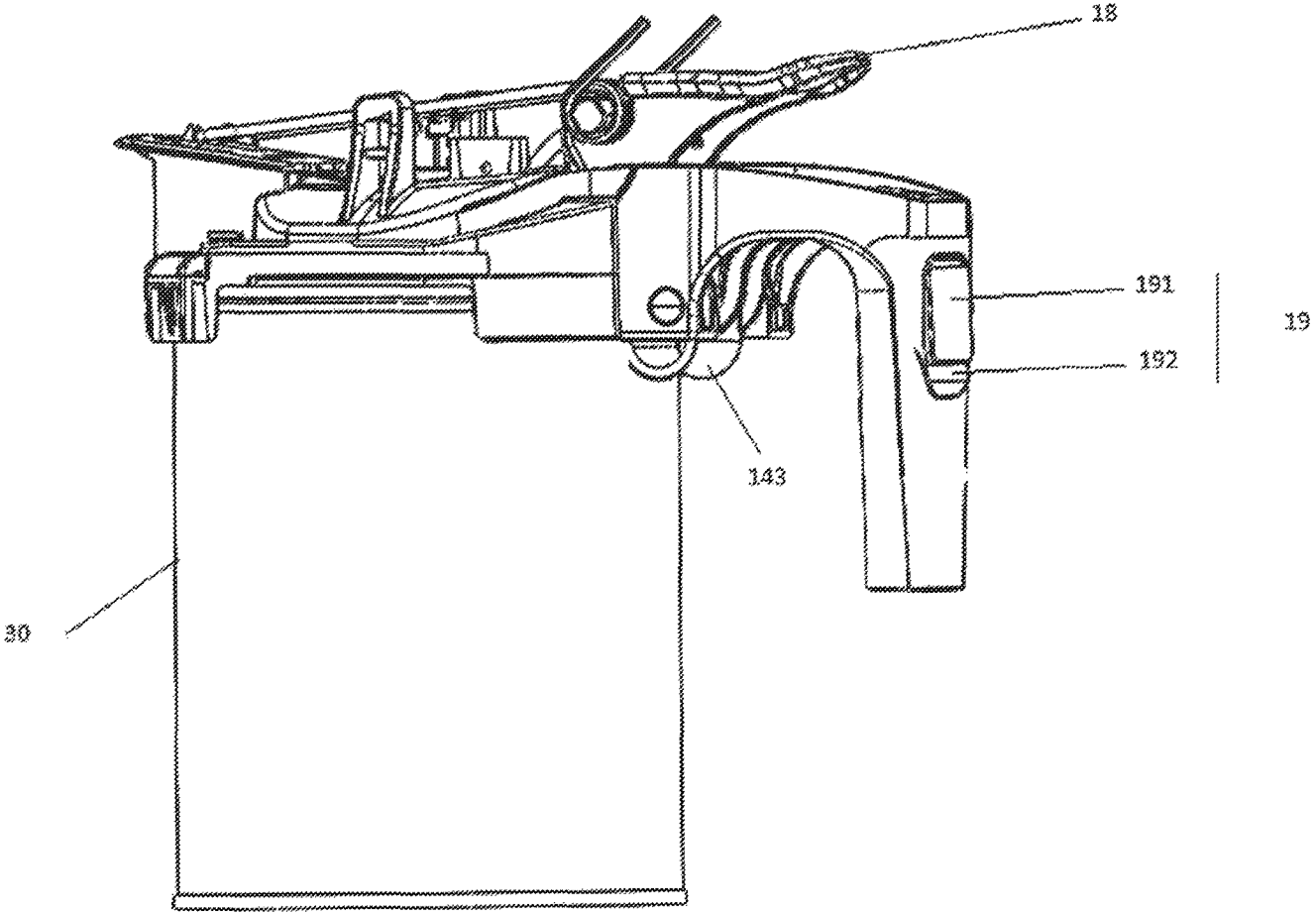
FIG. 4 is a perspective view of a can-and-lid assembly in which the active fastener portions of the catches of the lid are positioned on the can at a level lower than the external radial peripheral rim of the can, the pivotally movable catch being locked so that it is prevented from pivoting.
Figure 5:
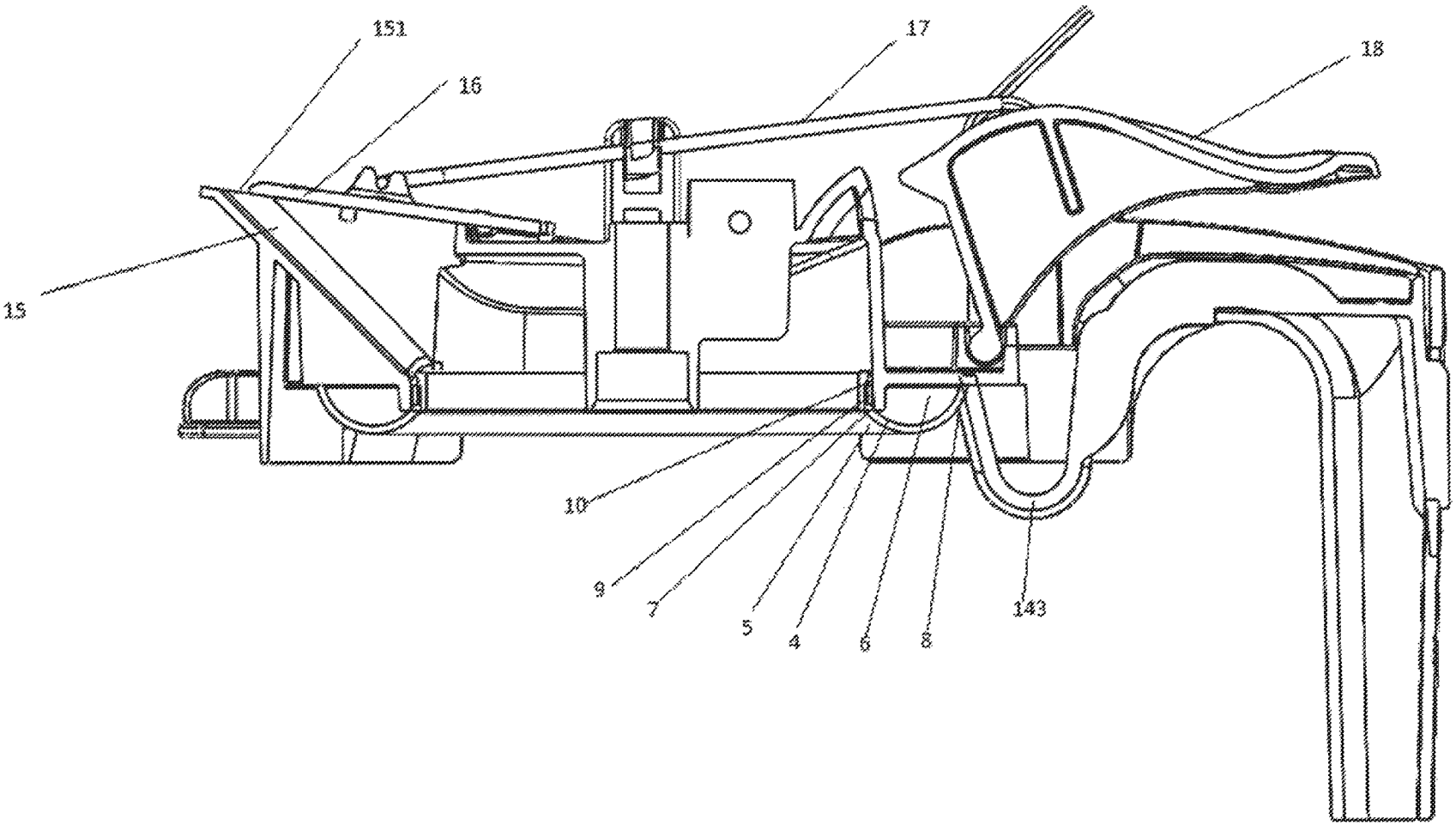
FIG. 5 is a section view of the lid with the pivotally movable catch being in the locked position.
Figure 6:
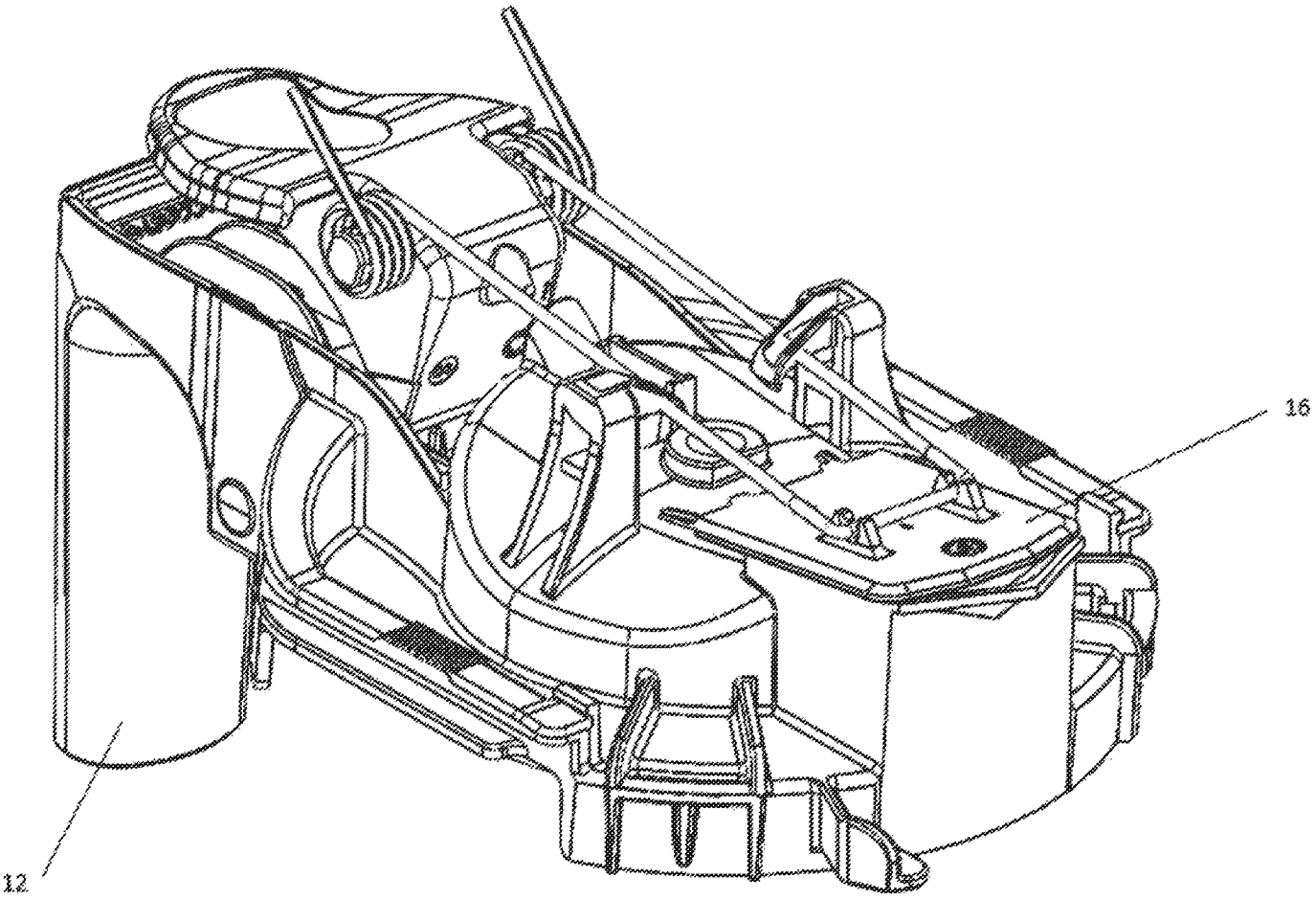
FIG. 6 is a perspective view of a lid, seen from another angle.
Figure 7:
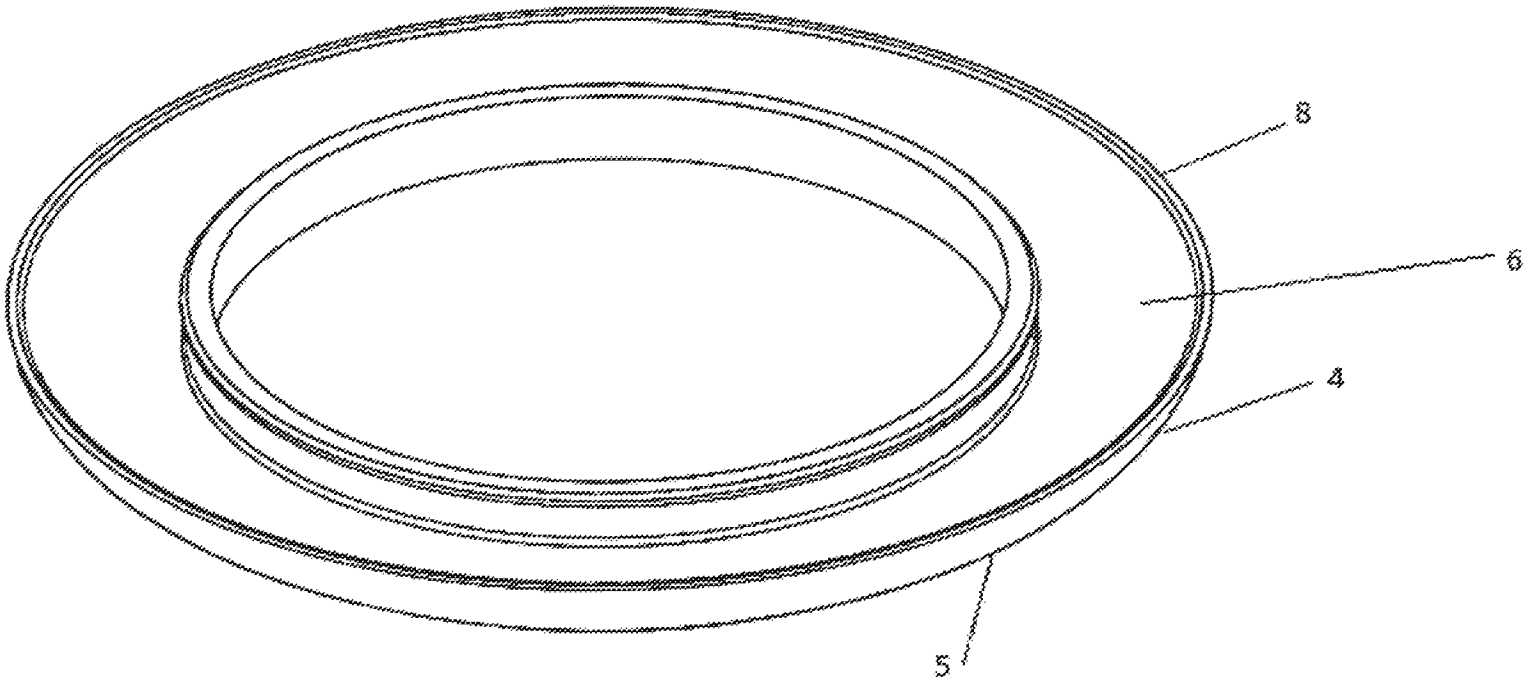
FIG. 7 is a perspective view of a gasket, on its own, seen from the face of the gasket that faces towards the bottom face of the lid.
Figure 8:
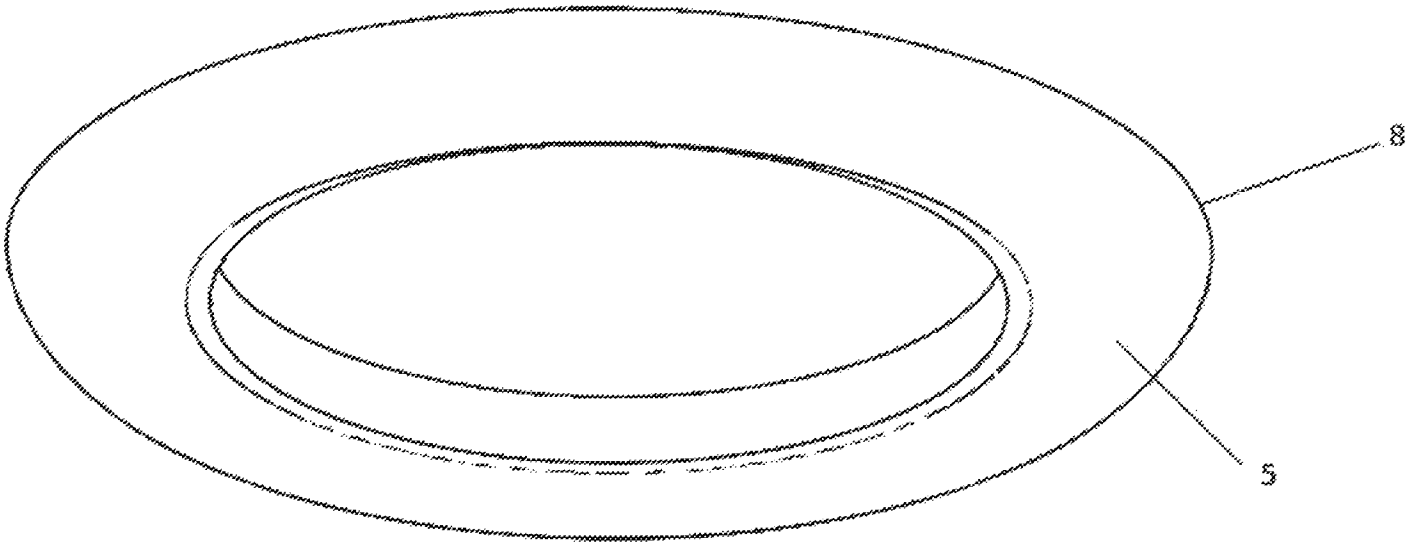
FIG. 8 is a perspective view of a gasket, on its own, seen from the convex face of the gasket that faces outwards from the lid.
Figure 9:
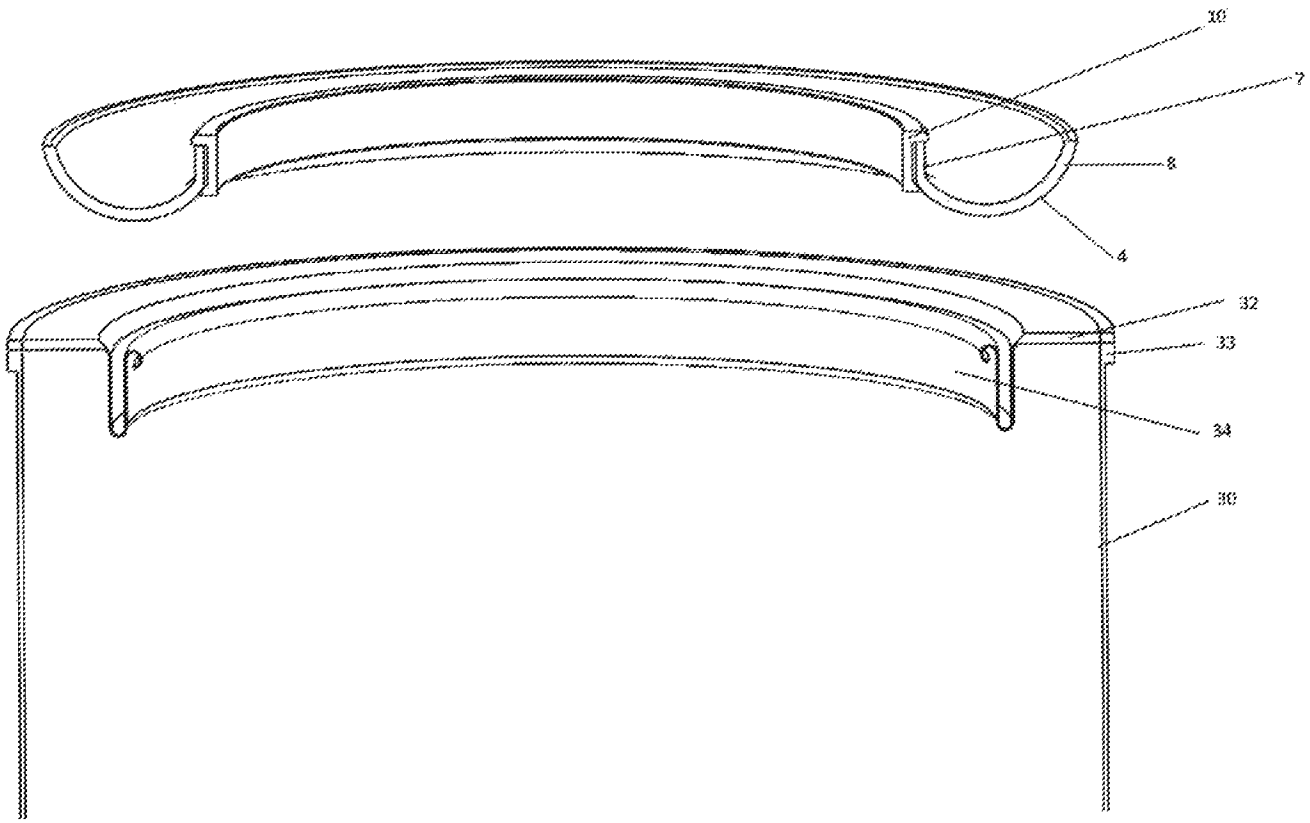
FIG. 9 is a fragmentary view of the gasket and of its annular fastening band for fastening to the lid, in the state in which the lid is positioned above a can.
Figure 10:
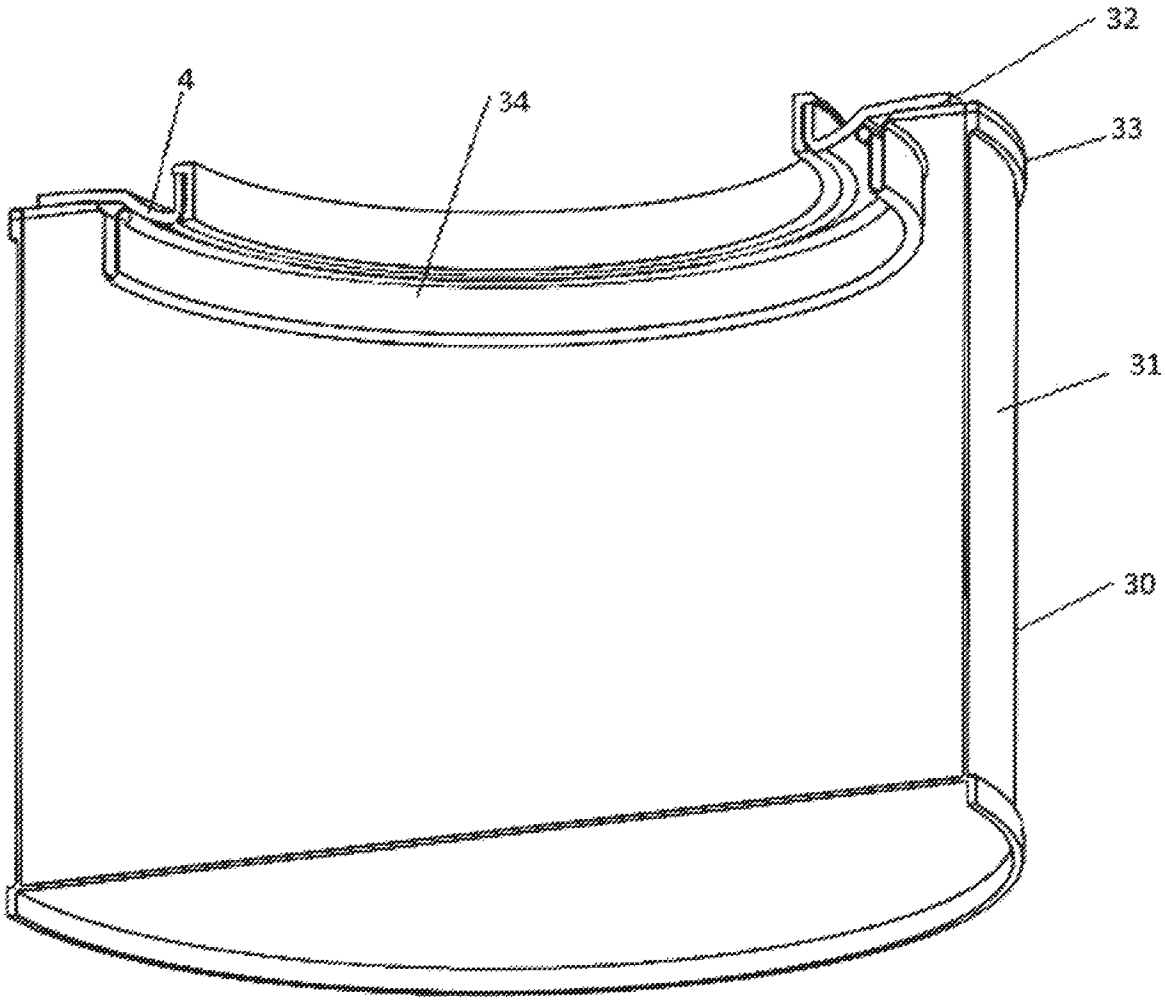
FIG. 10 is a fragmentary view of the gasket and of its annular fastening band for fastening to the lid, in the state in which the lid is applied against the top opening of the can.

As mentioned above, the invention relates to a lid 1 for closing a can 30, and to the assembly made up of the lid and of the can.

As shown in the figures, the can 30, such as a can of paint, has a tubular side wall 31 that, at or in the vicinity of one end, is provided with an internal radial collar 32 defining a "top" opening 34 that is substantially circular.

The tubular side wall 31 of the can is further provided with an external radial peripheral rim 33 also disposed substantially at the same level as the top opening 34 and at the same level as the internal radial collar 32. The top opening 34 of the can 30 is closed by the lid 1.

The lid 1 has a bottom face 2 provided with an annular sealing gasket 4 suitable for coming to bear against said collar 32 when the top opening 34 of the can 30 is in the closed state in which it is closed by said lid. Said annular sealing gasket 4 is an elastically deformable gasket that, in the non-deformed state, is in the general shape of a half-torus, with its convex side facing towards the can. The convex surface of the sealing gasket 4 is shown at 5 in the figures.

In the examples shown, this half-torus is hollow. This half-torus is open on its face 6 that faces towards the lid 1.

This sealing gasket 4 has an inner circumferential edge 7, and outer circumferential edge 8, and at least one connection zone 9 for connecting to the lid and disposed at one of its circumferential edges. The other circumferential edge of the sealing gasket is free.

In the example shown, the sealing gasket 4 is fastened to the lid 1 either via an annular band. 10 mounted in such a manner as to be secured to or integral with the inner circumferential edge 7 of the gasket, the outer circumferential edge 8 of the gasket being free, or via an annular snap ring 10' defining an open ring. The band 10 is engaged by force into an annular recess provided in the bottom face of the lid. The snap ring 10' is received, inside the gasket and acts by thrusting on the inner circumferential edge 7 of the gasket to engage it into an annular groove provided in the bottom face of the lid.

The lid is also provided with a handle 12.

The lid also has fastener means 14 for fastening the lid 1 to the can 30.

In this example, these fastener means 14 comprise three catches 141, 142, 143, or 143' disposed around the sealing gasket 4 and extending at least partially projecting from the bottom face 2 of the lid.

These three catches are disposed in such a manner as to be mutually spaced apart around the circumference of the lid. The bottom face 2 of the lid is provided, over at least a portion of its periphery, with an annular edge forming a dropped edge of the bottom face. This annular edge covers at least a portion of the tubular side wall 31 of the can when the lid is positioned over the top opening 34 of the can 30.

Two of the catches shown at 141 and 142 are rigid catches formed integrally with said annular edge.

Each of the catches 141, 142, and 143 or 143' has an active fastener portion formed by a portion of the catch that projects towards the center of the lid. The active fastener portion 1411 and 1421 of each of the rigid catches 141 and 142 is formed by a latch or tooth provided on the surface of the catch that faces towards the center of the lid.

The third catch 143 or 143' is a movable catch that is movable between a closer position in which its active fastener portion 1431 is closer to the active fastener portions of the other catches and a farther-away position in which its active fastener portion 1431 is farther away from the active fastener portions of the other catches.

These active fastener portions are suitable for coming to position themselves under the external radial peripheral rim 33 of the can in the closer position corresponding to the active closure position of the lid, when the lid 1 is positioned over the top opening 34 of the can.

In the example shown in FIGS. 1 to 10, for moving its active fastener portion 1431 between a closer position in which it is closer to the active fastener portions of the other catches 141, 142 and a farther-away position in which it is farther away from the active fastener portions of the other catches 141, 142, the third catch 143 is mounted to move pivotally about an axis (XX') substantially parallel to a circumferential plane of the annular sealing gasket 4.

For said pivotally movable catch 143, the lid includes locking means 19 for preventing said pivotally movable catch 143 from pivoting when its active fastener portion is in the closer position in which it is closer to the active fastener portions of the other catches, these locking means 19 being unlockable.

In the example shown, the pivotally movable catch 143 is V-shaped between its pivot connection and its free end, the branch of the V-shape that carries the free end of the catch forming the active fastener portion 1431 of the catch 143.

In the example shown, this active fastener portion 1431 of the pivotally movable catch 143 is elastically deformable.

The elastic deformation takes place by the branches of the V-shape moving closer together.

The other branch of the V-shape is provided with two pin portions, each of which engages into a respective pin bearing provided in the remainder of the lid. The pin bearings and pin portions form the pivot connection elements enabling the pivotally movable catch 143 to be pivotally mounted.

For the purpose of operating the pivotally movable catch 143, the lid is provided with a control lever 20 for causing the catch to be pivotally moved. In this example, the control lever 20 is formed integrally with the catch and forms an extension to the branch of the V-shape of the catch that is equipped with a pivot connection.

The means 19 for locking the pivotally movable catch 143 to prevent it from pivoting when its active fastener portion is in the closer position in which it is closer to the active fastener portions of the other catches comprise first locking means 191 mounted to be constrained to move with the pivotally movable catch 143 and stationary second locking means 192 carried by the handle 12, these first and second locking means being coupled together in the locked position and decoupled in the unlocked position.

These first locking means 191 are formed by a latch or lug carried by the control lever 20 and the second locking means 192 are formed by a slot provided in the handle, and in particular in the vertical branch of the handle.

In the coupled state corresponding to the locked position, the latch is inserted into the slot.

For unlocking, since the lever is elastically deformable, it suffices to press on the latch to generate deformation of the lever, thereby enabling the latch to exit from the slot. Once unlocked, the movable catch 143 can be caused to move pivotally in the direction in which its active fastener portion moves away from the active fastener portions of the other catches.

For locking, the reverse procedure applies: the pivotally movable catch 143 is caused to move pivotally in the direction in which its active fastener portion moves closer to the other active fastener portions or closer to the center of the lid, until a position is reached in which the latch carried by the control lever 20 for causing the catch 143 to move comes, by snap-fastening, to be received in the slot provided in the handle 12.

Figure 11:
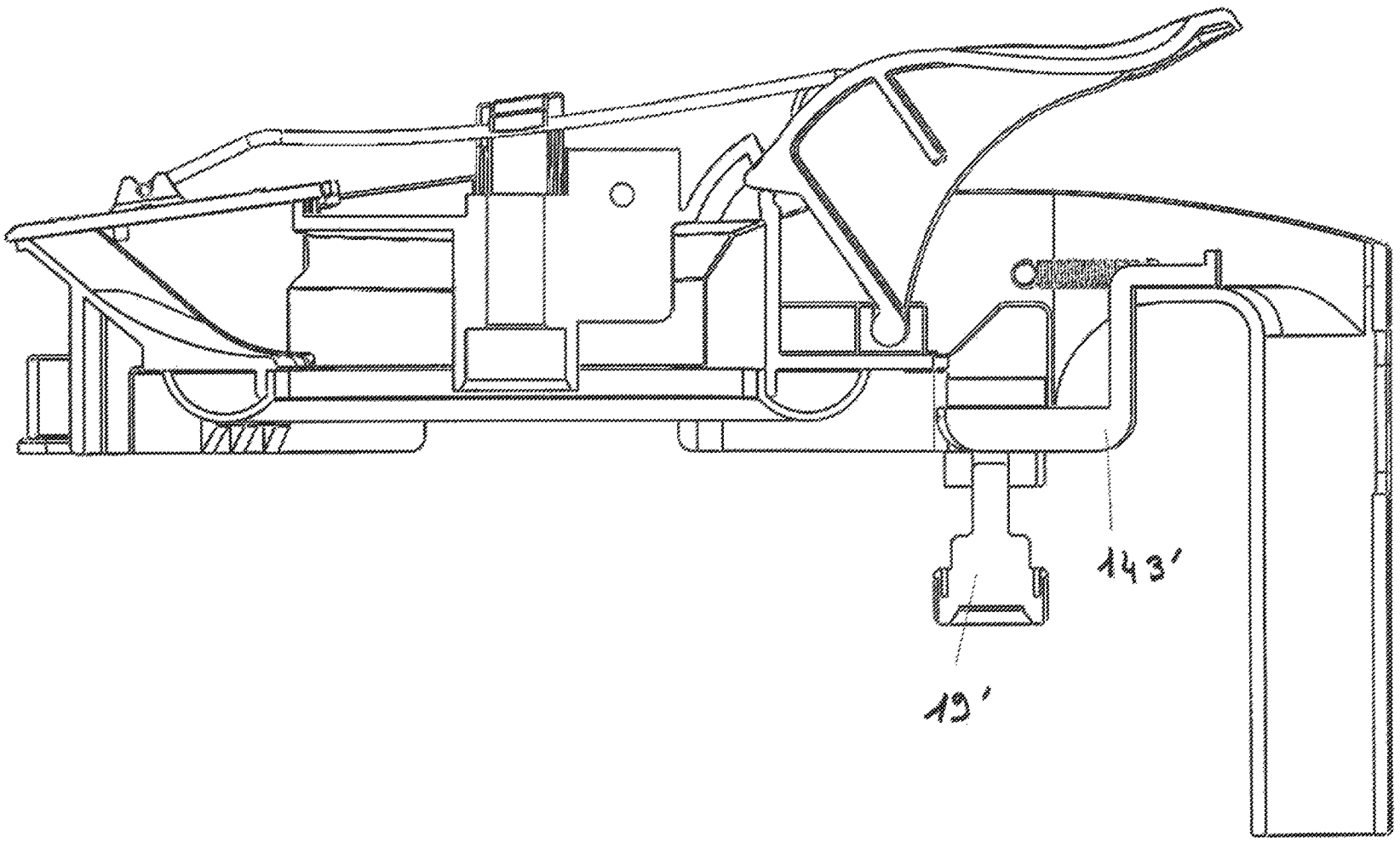
FIG. 11 is a section view of a lid with the slidably movable catch in the unlocked position.
Figure 12:
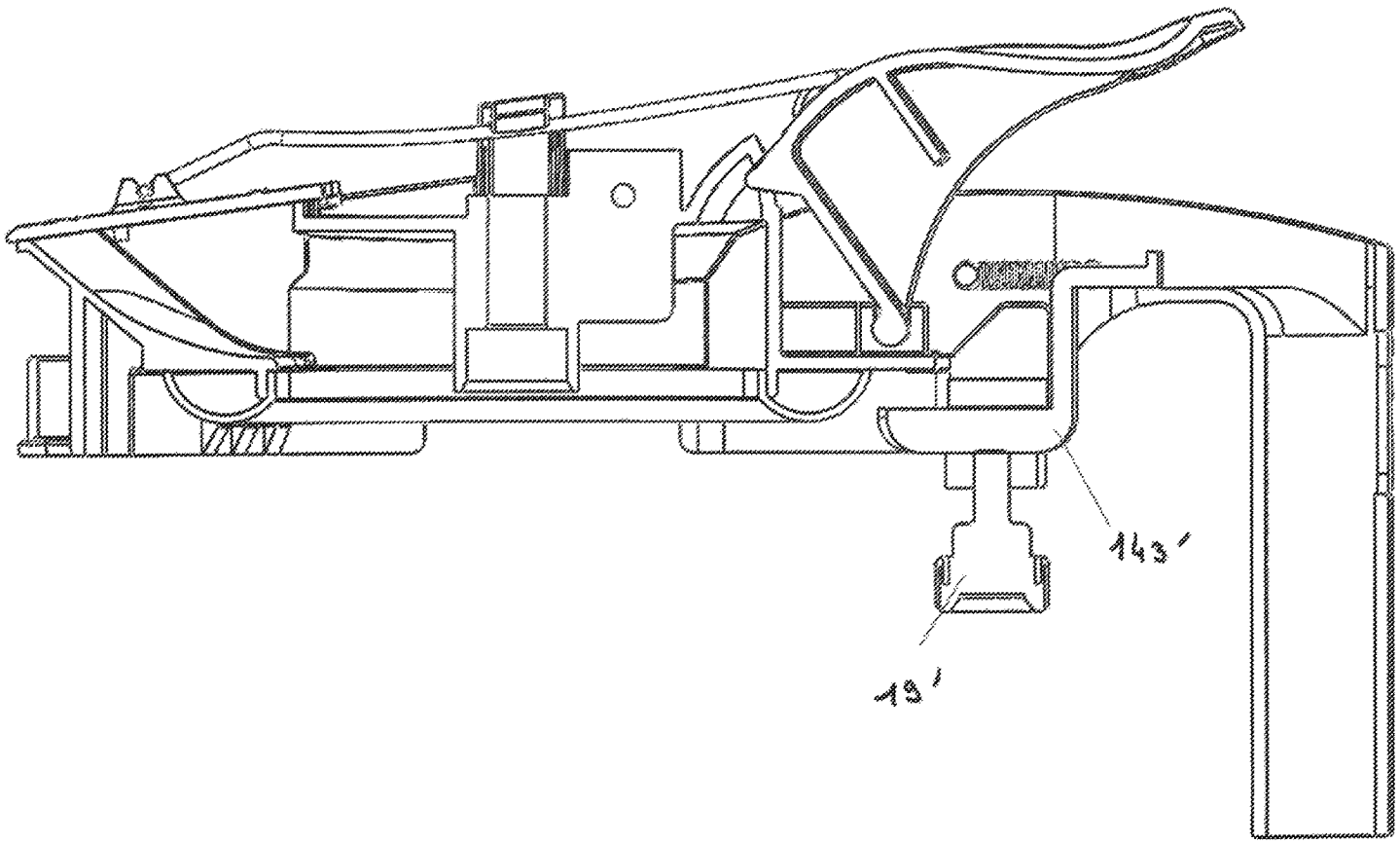
FIG. 12 is a section view of a lid with the slidably movable catch in the locked position.
Figure 13:
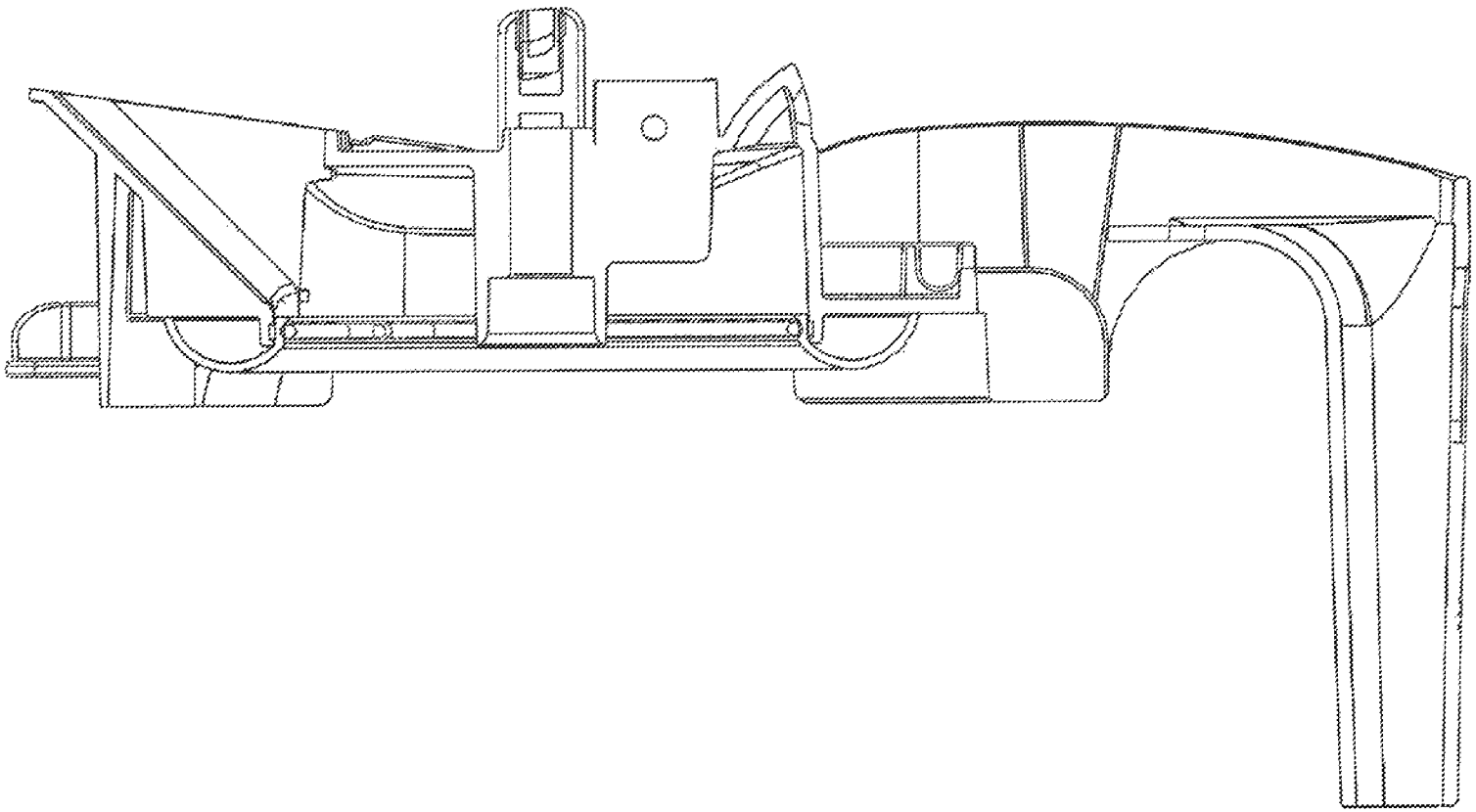
FIG. 13 is a section view of a lid with its gasket and the fastener means for fastening the gasket to the lid.
Figure 14:
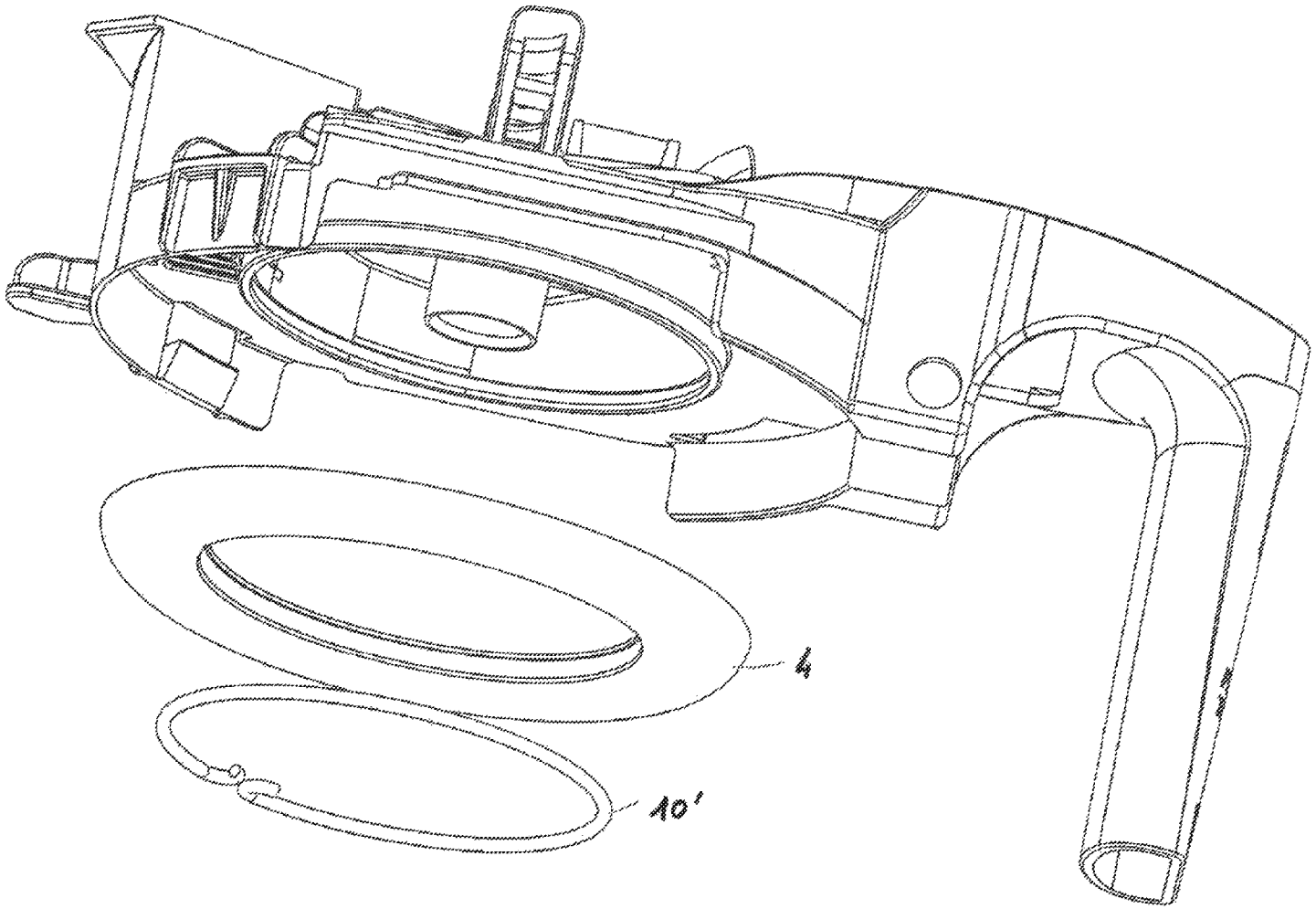
FIG. 14 is a perspective view of an assembly comprising the lid, the gasket, and the fastener snap ring for fastening the gasket, with the three component elements of the assembly shown in exploded manner.

In the example shown in FIGS. 11 and 12, the movable catch 143' is a slidably movable catch that can be moved by sliding in a plane substantially parallel to a circumferential plane of the annular sealing gasket. This catch 143' is a spring-loaded catch that is mounted to move against the drive from the spring in the direction in which its active fastener portion 1431 moves away from the active fastener portions of the other catches. This catch 143' is lockable in the position in which its active fastener portion is closer to the active fastener portion of at least one other catch via the locking means 19' that, in this example, are formed by a thumbscrew that can be tightened or loosened in the lid. In the locked position, the free end of the thumbscrew comes to bear against a face of the slidably mounted catch so as to prevent it from sliding.

As mentioned above, in the examples shown, the lid is also provided with a handle 12. This external radial handle 12 is in the form of an upside-down L-shape.

It should be observed that in the example shown, the horizontal branch of the upside-down L-shape of the handle is, in this example, hollow to make it possible to receive the control lever 20 for causing the pivotally movable catch 143 to move and to go from one position to another.

In the examples shown, the lid also has a top face 3 opposite from the bottom face 2 and that forms a pouring spout 15. The pouring spout 15 has a seat 151 for a closure flap 16. The seat 151 is formed by the open top surface of the pouring spout.

In the examples shown, the seat 151 of the pouring spout 15 slopes downwards from the periphery towards the center of the lid 1. The closure flap 16 is a sliding closure flap equipped with return means 17 for urging it back into the closed position, and with a pivotally mounted active opening control 18 acting against said return means 17. The pivotally mounted control lever 18 for opening the closure flap 16 lies above the pivotally movable catch 143.

In this example, the closure flap 16 is formed merely by a plate, and the return means 17 are implemented in the form of a hairpin spring; the manner in which this spring o-operates with the closure flap is already known from the state of the art and is therefore not described in detail.

The pivotally mounted control lever 18 for opening the closure flap 16 that overlies the pivotally movable catch 143 is mounted to move pivotally about an axis parallel to the pivot axis (XX') of the pivotally movable catch 143 that it overlies.

This pivotally mounted opening control lever 18 for opening the closure flap 16 also, if necessary, when the closure flap is caused to open, forms a locking control member for locking the locking means 19 for preventing pivoting of the pivotally movable catch 143 that underlies said lever 18.

Specifically, if the control lever 20 for causing the movable catch 143 to pivot has not already been actuated to bring the movable catch 143 into the locked position, it can be actuated by the pivotally mounted opening control lever 18 for opening the closure flap 16 that overlies it.

Thus, the closure flap going from the closed position to the open position can make it possible, in parallel, for the catch 143 to go from the unlocked position to the locked position.

When the lid 1 is a stirrer lid, the lid 1 is also provided with a central opening 13 designed for the rotary shaft of a mixer assembly.

In practice, closing a can by using a lid as described above can take place as follows: the lid 1 is positioned with its bottom face facing the top opening of the can. The pivotally movable catch 143 of the lid is unlocked and its active fastener portion 1431 is farther away from the active fastener portions 1412 and 1421 of the other fastening catches or from the center of the lid.

The active fastener portions 1412 and 1421 of the rigid, i.e. non pivotally mounted, catches 141 and 142 are positioned under the external radial peripheral rim 33 of the can. Via its control lever 20 that is operated by the operator's hand that is holding the handle 12 for taking hold of the lid, the pivotally movable catch 143 is caused to move pivotally into a position in which the active fastener portion 1431 of the pivotally movable catch 143 is disposed by bearing against the bottom face of the external radial peripheral rim 33, i.e. the face of the external radial peripheral rim 33 that faces towards the bottom of the can that is opposite from the end face of the can that carries the top opening.

When the catch is in this position, the latch 191 of the control lever 20 for causing the movable catch 143 to pivot engages in the slot 192 of the handle and the catch is locked so that any pivotal movement of the catch 143 in an opposite direction is prevented.

Fastening the lid 1 to the can is complete. In a variant, provision may be made firstly to bring the active fastener portion of the pivotally movable catch under the peripheral rim of the can before exerting thrust on the lid and before pushing the lid to bring the active fastener portions of the rigid catches 141 and 142 under the peripheral rim of the can. Actuating the movable catch and locking it then take place as described above.

The closure flap of the pouring spout can be actuated to move in the opening direction by means of the pivotally mounted lever 18. Releasing the lever 18 automatically causes the closure flap to return to the closed position, by it being urged back by the return means 17.

To separate the lid from the can, it suffices to exert pressure on the latch 191 in the direction in which the latch 191 is extracted from the slot 192, and then to cause the catch 143 to be moved pivotally in the direction in which the active fastener portion 1431 of the catch moves farther away from the active fastener portions of the other catches or from the center of the lid.

For actuating of the pivotally movable catch 143 so that it moves in the direction in which its active fastener portion moves closer to the active fastener portions of the other catches, it is possible to act on the operating lever 18 for operating the closure flap, this lever 18 coming, during its pivoting, to bear against the operating lever 20 and causing it to move into an end-of-stroke position in which it is locked.

It should be observed that operating the control lever 18 for opening the closure member and operating the control lever 20 for causing the catch 143 to move pivotally is performed by the operator's hand that is holding the handle 12. It is the thumb of that hand that makes it possible to act on the two levers.

Thus, in spite of the presence of two levers, a single hand suffices to actuate both of the levers.

When the movable catch is a slidably movable catch, as shown in FIG. 11, the operator exerts traction on the catch 143' against the action of the spring in order to move it farther away from the other catches and then releases said catch whose active fastener portion comes to be positioned under the external radial peripheral rim of the can in the position in which it bears against the outside face of the peripheral wall of the can. Locking is then performed to lock said catch in position.

The invention claimed is:

1. A lid for closing a can comprising:

a tubular side wall provided with a top opening, with an internal radial collar, and with an external radial peripheral rim, the collar and the rim being disposed substantially at the same level as the top opening, said lid having a bottom face provided with an annular sealing gasket suitable for coming to bear against said collar when the top opening of the can is in the closed state in which it is closed by said lid, and said lid being provided with fastening means for fastening the lid to the can, which fastening means comprise at least two catches disposed around the sealing gasket and extending at least partially projecting from the bottom face of the lid, at least two or each of the catches having an active fastener portion formed by a portion of the catch that projects towards the center of the lid, at least one of the catches is a pivotable catch, being pivotable about a fixed axis between a closer position in which its active fastener portion is closer to the active fastener portion of at least one other catch and a farther-away position in which its active fastener portion is farther away from the active fastener portion of at least one other catch, said active fastener portions being suitable, in a closer position corresponding to the active closure position in which the lid is actively closed, for positioning themselves under the external radial peripheral rim of the can;

wherein that for said lid, for causing the active fastener portion of the pivotable catch, provided with an active fastener portion or of at least one of the pivotable catches provided with active fastener portions to pivot on its axis between a closer position in which it is closer to the active fastener portion of at least one other catch and a farther-away position in which it is farther away from the active fastener portion of at least one other catch, said pivotable catch provided with an active fastener portion or said at least one of the pivotable catches provided with active fastener portions is mounted to move about said fixed pivot axis, or in a plane substantially parallel to a circumferential plane of the annular sealing gasket, and in that, for said at least one pivotable catch, the lid is provided with a separate locking means for locking said pivotable catch in the closer position in which its active fastener portion is closer to the active fastener portion of at least one other catch, these separate locking means being unlockable.

2. The lid according to claim 1, wherein the locking means comprise first locking means mounted to be constrained to move with the movable catch and stationary second locking means, said first and second locking means being coupled together in the locked position and decoupled in the unlocked position.

3. The lid according to claim 2, wherein the first and second locking means are of the male/female type.

4. The lid according to claim 1, wherein the locking means are at least partially elastically deformable and are suitable for going from the locked position to the unlocked position, and vice versa, by elastic deformation combined with pivotal movement of the pivotable catch.

5. The lid according to claim 1, wherein the lid has a top face opposite from the bottom face and that forms a pouring spout having a seat for a closure flap, said closure flap being a slidably mounted closure flap equipped with return means for urging it back into the closed position, and with a pivotally mounted active opening control lever for actively opening the closure flap by acting against said return means, said pivotally mounted opening control lever for opening the closure flap overlying the movable catch or one of the movable catches.

6. The lid according to claim 5, wherein the pivotally mounted opening control lever for opening the closure flap is mounted to move pivotally about an axis parallel to the pivot axis or to the movement plane of the pivotable catch that it overlies.

7. The lid according to claim 5, wherein said at least one movable catch is a pivotable catch and wherein the pivotally mounted opening control lever for opening the closure flap also, if necessary, when the closure flap is caused to open, forms a locking control member for locking the locking means for preventing pivoting of the pivotally movable catch that underlies said lever.

8. The lid according to claim 5, wherein the seat of the pouring spout slopes downwards from the periphery towards the center of the lid.

9. The lid according to claim 1, wherein the annular sealing gasket is an elastically deformable gasket that, in the non-deformed state, is in the general shape of a half-torus with its convex side facing towards the can.

10. The lid according to claim 1, wherein said lid is provided with a handle.

11. The lid according to claim 10, wherein at least a portion of the locking means is carried by the handle.

12. The lid according to claim 11, wherein the locking means comprise first locking means mounted to be constrained to move with the movable catch and stationary second locking means, said first and second locking means being coupled together in the locked position and decoupled in the unlocked position, and wherein the portion of the locking means carried by the handle forms the stationary second locking means.

13. The lid according to claim 10, wherein either said at least one movable catch is a pivotally mounted catch or wherein the locking means comprise first locking means mounted to be constrained to move with the movable catch and stationary second locking means, said first and second locking means being coupled together in the locked position and decoupled in the unlocked position, and wherein the pivotally movable catch or at least one of the pivotally movable catches is mounted to move pivotally via a control lever for causing it to move pivotally, and in that the first locking means for preventing pivotal movement of said pivotally movable catch are carried by said control lever and the second locking means are carried by the handle.

14. An assembly comprising:

firstly a can having a tubular side wall provided with a top opening, with an internal radial collar, and with an external radial peripheral rim, the collar and the rim being disposed substantially at the same level as the top opening, and secondly a lid for closing the can, said lid, which is dimensioned to cover the top opening of the can, being provided with fastening means for fastening to the can, and, on its bottom face, with an elastically deformable annular sealing gasket that is suitable for coming to bear against said collar when the top opening of the can is in the closed state in which it is closed by said lid, said fastening means comprising at least two catches disposed around the sealing gasket and extending at least partially projecting from the bottom face of the lid, at least two or each of the catches having an active fastener portion formed by a portion of the catch that projects towards the center of the lid, at least one of the catches is a pivotable catch, being movable about a fixed pivot axis between a closer position in which its active fastener portion is closer to the active fastener portion of at least one other catch and a farther-away position in which its active fastener portion is farther away from the active fastener portion of at least one other catch, said active fastener portions being arranged, in a closer position corresponding to the active closure position in which the lid is actively closed, for positioning themselves under the external radial peripheral rim of the can, when the lid is positioned over the top opening of the can; wherein said lid is a lid according to claim 1.

* * * * *